US009020411B2

(12) United States Patent
Konishi

(10) Patent No.: US 9,020,411 B2
(45) Date of Patent: Apr. 28, 2015

(54) TONER RECOVERY DEVICE AND IMAGE FORMING APPARATUS HAVING THE TONER RECOVERY DEVICE

(71) Applicant: KYOCERA Document Solutions Inc., Osaka (JP)

(72) Inventor: Hirohito Konishi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 183 days.

(21) Appl. No.: 13/719,513

(22) Filed: Dec. 19, 2012

(65) Prior Publication Data

US 2013/0164063 A1 Jun. 27, 2013

(30) Foreign Application Priority Data

Dec. 22, 2011 (JP) ..... 2011-281315

(51) Int. Cl.
*G03G 21/00* (2006.01)
*G03G 21/10* (2006.01)

(52) U.S. Cl.
CPC ..... *G03G 21/105* (2013.01); *G03G 2215/0833* (2013.01)

(58) Field of Classification Search
CPC ..... G03G 21/105; G03G 21/12; G03G 21/10
See application file for complete search history.

(56) References Cited

U.S. PATENT DOCUMENTS

| | | | | |
|---|---|---|---|---|
| 2005/0002709 | A1 * | 1/2005 | Jeong et al. | 399/358 |
| 2007/0104515 | A1 * | 5/2007 | Akedo | 399/254 |
| 2011/0229213 | A1 | 9/2011 | Mihara et al. | 399/263 |
| 2011/0255907 | A1 | 10/2011 | Mihara et al. | 399/263 |

FOREIGN PATENT DOCUMENTS

| | | | |
|---|---|---|---|
| JP | 4-174471 | | 6/1992 |
| JP | 2006-119549 | | 5/2006 |
| JP | 2009122238 | A * | 6/2009 |
| JP | 2010107930 | A * | 5/2010 |
| JP | 2010-134386 | | 6/2010 |
| JP | 2010-224284 | | 10/2010 |

* cited by examiner

*Primary Examiner* — Clayton E Laballe
*Assistant Examiner* — Victor Verbitsky
(74) *Attorney, Agent, or Firm* — Ostrolenk Faber LLP

(57) ABSTRACT

A toner recovery device includes a toner recovery container that recovers toner; and a toner conveying shaft member that is provided inside the toner recovery container and conveys toner in a axial direction of the toner conveying shaft member by the rotation around a rotational axis of the toner conveying shaft member and that has a spiral groove formed around the rotational axis and an outer peripheral surface whose distance from the rotational axis is variable.

7 Claims, 7 Drawing Sheets

TONER RECOVERY DEVICE AND IMAGE FORMING APPARATUS HAVING THE TONER RECOVERY DEVICE

Priority is claimed on Japanese Patent Application No. 2011-281315, filed Dec. 22, 2011, the content of which is incorporated herein by reference.

BACKGROUND OF THE INVENTION

1. Field of the Invention

The present disclosure relates to a toner recovery device and an image forming apparatus having the toner recovery device.

2. Description of Related Art

In image forming apparatuses, for example, a method that causes a transfer image formed with toner to be carried on the peripheral surface of a photoreceptor drum, and directly transfers the image carried on the peripheral surface of the photoreceptor drum to paper or the like; or a method that causes the image carried on the peripheral surface of the photoreceptor drum to be carried on an intermediate transfer belt and indirectly transfers the image, or the like, is widely used.

In a case where such a method is used, after an image is made to be transferred to paper, a minute amount of toner may remain on the surface of an image carrier (a photoreceptor drum, an intermediate transfer belt, or the like).

The residual toner on the surface of the image carrier becomes an obstacle when the next new image is formed.

Accordingly, the residual toner needs to be removed by the cleaning device.

The toner removed by the cleaning device is conveyed inside a conveying pipe by conveying members, such as a screw, and is recovered as waste toner by a toner recovery device.

The toner recovery device includes a toner recovery container that stores waste toner, and the waste toner is stored inside the toner recovery container.

Additionally, although the toner recovery container is desired to enlarge the capacity of waste toner, it is difficult to enlarge the container body itself due to restrictions on the arrangement of the container body inside an image forming apparatus body, or the like.

For this reason, it is necessary to efficiently store the waste toner so that the waste toner can be stored in a limited storage space of the container body as much as possible.

In a related-art toner recovery device, a toner feed member for feeding the waste toner to the back of the container body is provided inside the container body.

This toner feed member is a screw that has a device shaft and a fin portion erected from the device shaft, and can feed the waste toner in the axial direction in which the device shaft extends, with rotation around the device shaft.

Incidentally, the above related-art toner recovery container has an elongated shape along the axial direction of the screw.

For this reason, the waste toner can be efficiently stored in the storage space of the container body by conveying the waste toner sequentially to the back side of the container body by the screw.

However, if the toner is conveyed in this way, there are problems in that restrictions are reversely imposed to the shape of the toner recovery container and the degree of freedom in the shape of the container becomes reduced.

For example, in a case where a container shape with sufficient width with respect to the screw is adopted, the waste toner can be efficiently stored in the axial direction of the screw, but the waste toner cannot be efficiently stored in the radial direction of the screw.

Accordingly, in a case where when toner is conveyed in the above related art, a sufficient storage space in the radial direction of the recovery container cannot be utilized.

The present disclosure has been made in view of the above problems, and an object thereof is to provide a toner recovery device and an image forming apparatus that have a high degree of freedom in the shape of a toner recovery container and can store toner efficiently.

SUMMARY OF THE INVENTION

A toner recovery device that is an aspect of the present disclosure includes a toner recovery container that recovers toner; and a toner conveying shaft member that is provided inside the toner recovery container and conveys toner in a axial direction of the toner conveying shaft member by the rotation around a rotational axis of the toner conveying shaft member and that has a spiral groove formed around the rotational axis and an outer peripheral surface whose distance from the rotational axis is variable.

Also, an image forming apparatus that is an aspect of the present disclosure includes the above toner recovery device.

DETAILED DESCRIPTION OF THE INVENTION

Hereinafter, an embodiment of the present disclosure will be described with reference to the drawings.

In addition, in the following description, an example in that a toner recovery device of the present disclosure is adapted to a copying machine (image forming apparatus) will be described.

Figure 1:
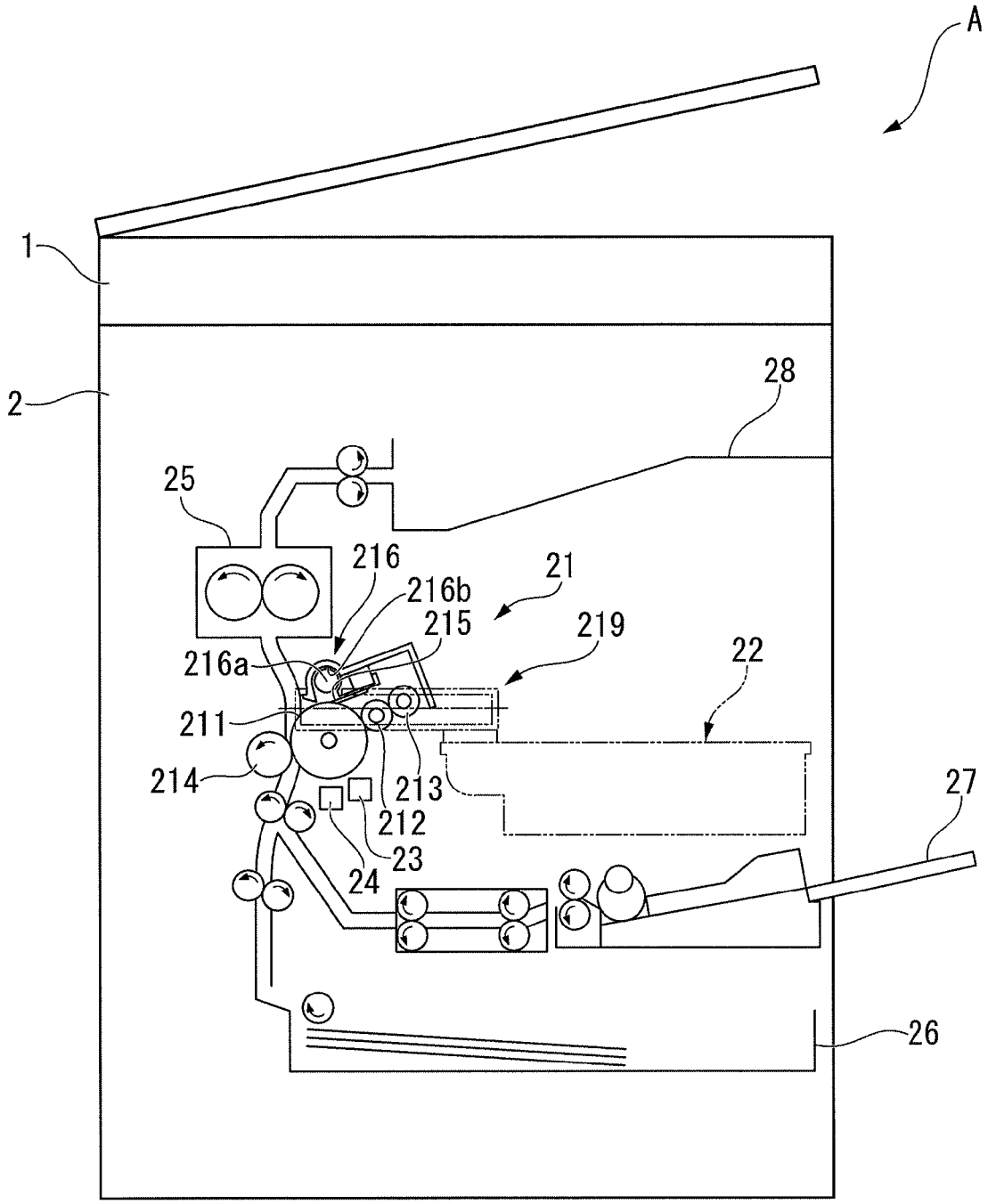
FIG. 1 is a schematic configuration view of a copying machine in the embodiment of the present disclosure.

FIG. 1 is a schematic configuration view of a copying machine A in the embodiment of the present disclosure.

The copying machine A of the present embodiment adopts a direct transfer system that directly transfers a toner image formed on the peripheral surface of a photoreceptor drum (image carrier) 211 to recording paper.

This copying machine includes an image reading section 1 that reads the image of an original, and an image forming section 2 that performs image formation on recording paper on the basis of image data.

The image reading section 1 is a so-called scanner that reads the image (original image) of an original placed on a glass platen (not shown) by an image sensor and converts the image into original image data, and the original image data is output to the image forming section 2.

The image forming section 2 forms (copies) the original image on recording paper on the basis of the original image data supplied from the image reading section 1.

The image forming section 2 has a photoreceptor unit 21, a toner recovery device 22, an exposure device 23, a developing device 24, a fixing device 25, a paper feed cassette 26, a paper feed tray 27, and a paper discharge tray 28, and the like.

Additionally, the photoreceptor unit 21 has a photoreceptor drum 211, a charging roller 212, a transfer roller 214, a cleaning device 215, and the like.

The photoreceptor drum 211 is a cylindrical rotary body that has a peripheral surface formed from a predetermined photosensitive material, and an electrostatic latent image and a toner image (transfer image) based on the electrostatic latent image are formed on the peripheral surface.

The charging roller 212 is arranged to face the photoreceptor drum 211, and changes the peripheral surface of the photoreceptor drum 211 into a charged state.

Moreover, the peripheral surface of the charging roller 212 is cleaned by a charging roller cleaning brush 213.

The exposure device 23 scans the peripheral surface of the photoreceptor drum 211 in a charged state with laser light emitted on the basis of printing type image data.

The developing device 24 supplies toner to the peripheral surface of the photoreceptor drum 211, thereby developing the toner image based on the electrostatic latent image, on the peripheral surface of the photoreceptor drum 211.

The transfer roller 214 is arranged to face the photoreceptor drum 211, and transfers the toner image developed by the photoreceptor drum 211 onto the recording paper.

The cleaning device 215 has a blade member of which the tip bumps against and comes into contact with the peripheral surface of the photoreceptor drum 211, and scrapes off and removes the toner (residual toner) which remains on the photoreceptor drum 211 after transfer with the blade member.

The removed toner is conveyed to the toner recovery device 22 (to be described below) by a toner conveying device 216.

The toner conveying device 216 includes a first conveying pipe 216*b* that conveys toner in the depth direction of the paper plane of FIG. 1 by a screw 216*a*, and a second conveying pipe 219 that is connected to the terminal end of the first conveying pipe 216*b* and conveys toner to the toner recovery device 22 by a screw (not shown).

The fixing device 25 includes a pair of rollers, and applies heat and pressure to the toner image on the recording paper transferred from the photoreceptor drum 211, thereby fixing the toner image on the recording paper.

The paper feed cassette 26 is a container that accommodates a bundle of recording paper.

Additionally, the paper feed tray 27 is an accommodating section that receives manually inserted recording paper.

The paper discharge tray 28 is an accommodating section that receives the recording paper that is supplied from the fixing device 25 and that has an image formed thereon.

Next, the configuration of the toner recovery device 22 will be described in detail with reference to FIGS. 2 to 6.

Figure 2:
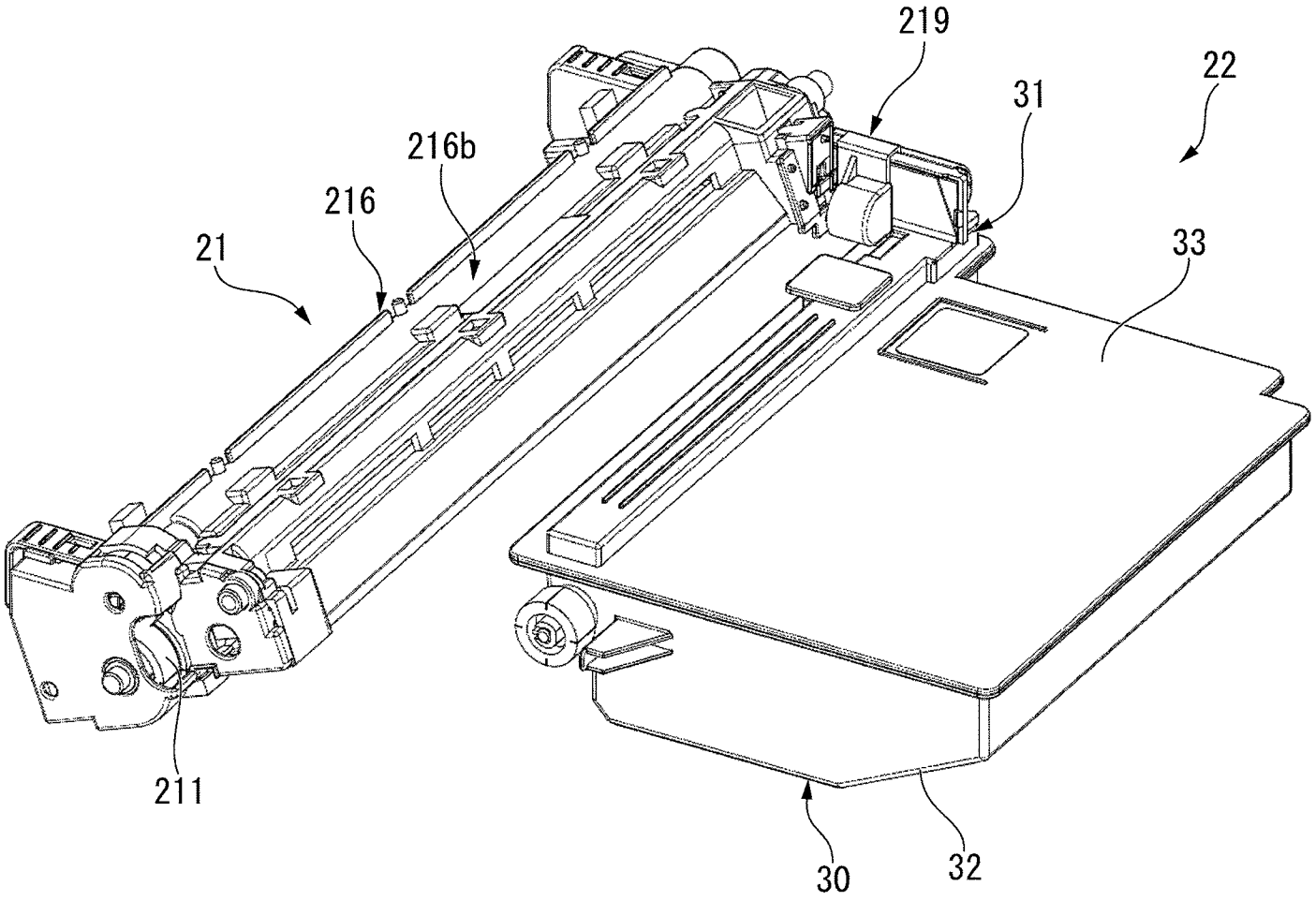
FIG. 2 is a perspective view of a toner recovery device in the embodiment of the present disclosure.

FIG. 2 is a perspective view of the toner recovery device 22 in the embodiment of the present disclosure.

Figure 3:
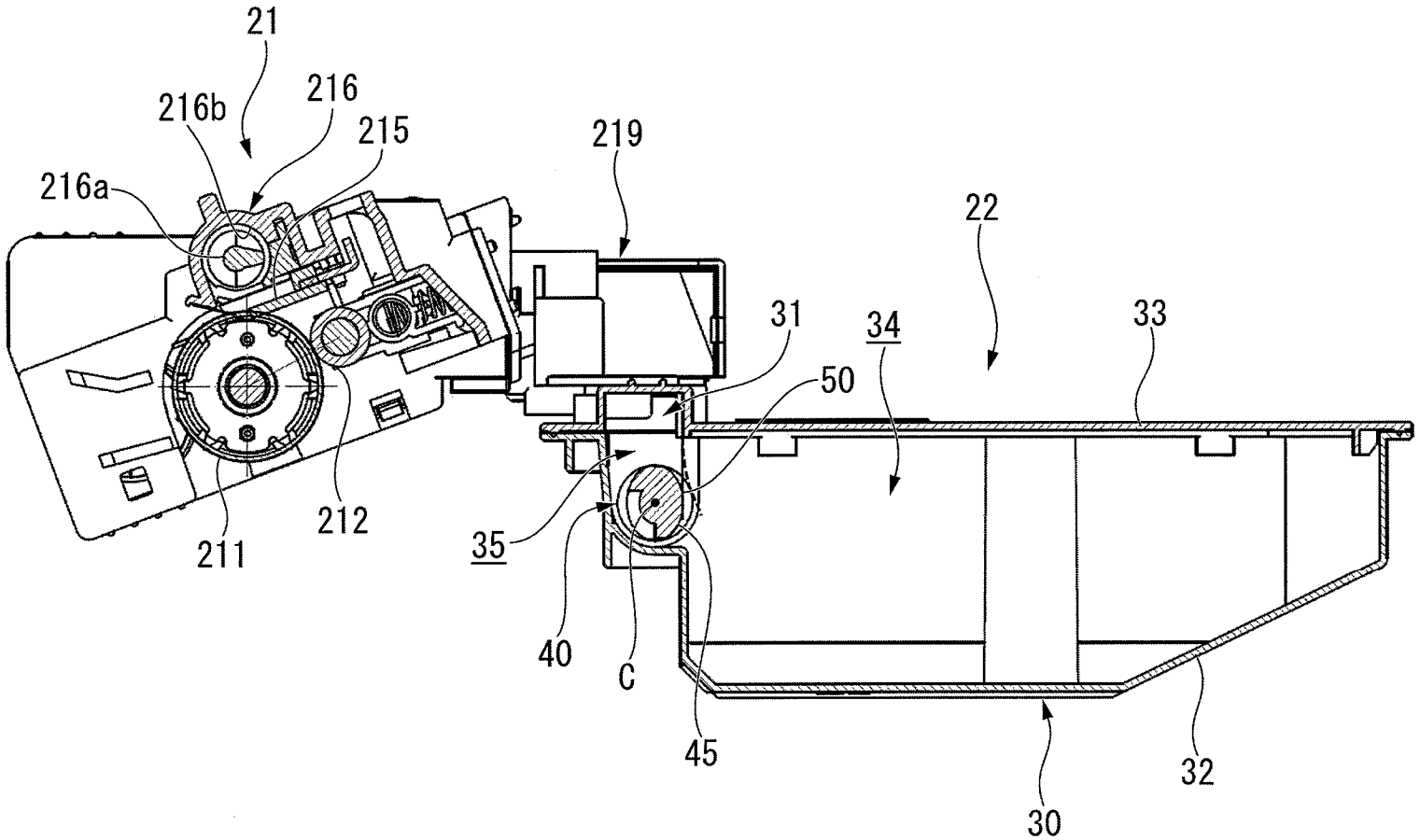
FIG. 3 is a cross-sectional view of the toner recovery device in the embodiment of the present disclosure.

FIG. 3 is a cross-sectional view of the toner recovery device 22 in the embodiment of the present disclosure.

Figure 4A:
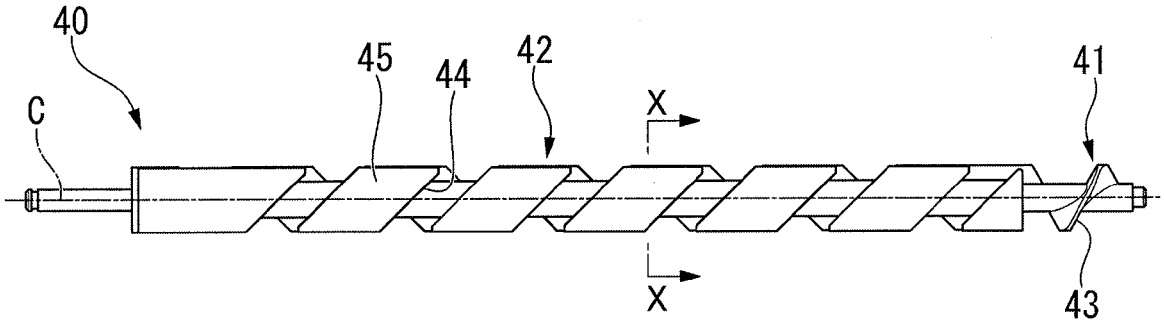
FIG. 4A is a configuration view of a toner conveying shaft member in the embodiment of the present disclosure.
Figure 4B:
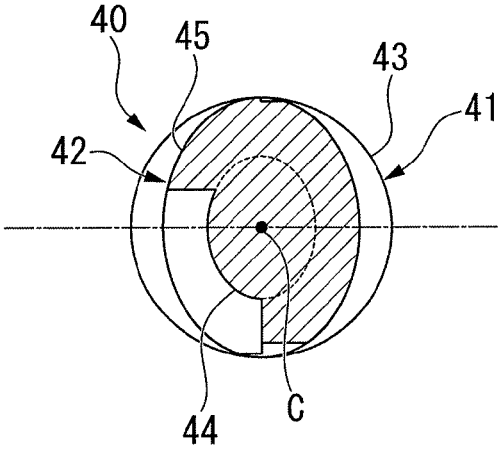
FIG. 4B is a configuration view of the toner conveying shaft member in the embodiment of the present disclosure (a cross-sectional view taken along line X-X, which is shown in FIG. 4A).

FIGS. 4A and 4B are configuration views of a toner conveying shaft member in the embodiment of the present disclosure.

In addition, FIG. 4A shows a plan view and FIG. 4B shows a cross-sectional view taken along line X-X, which is shown in FIG. 4A.

Figure 5:
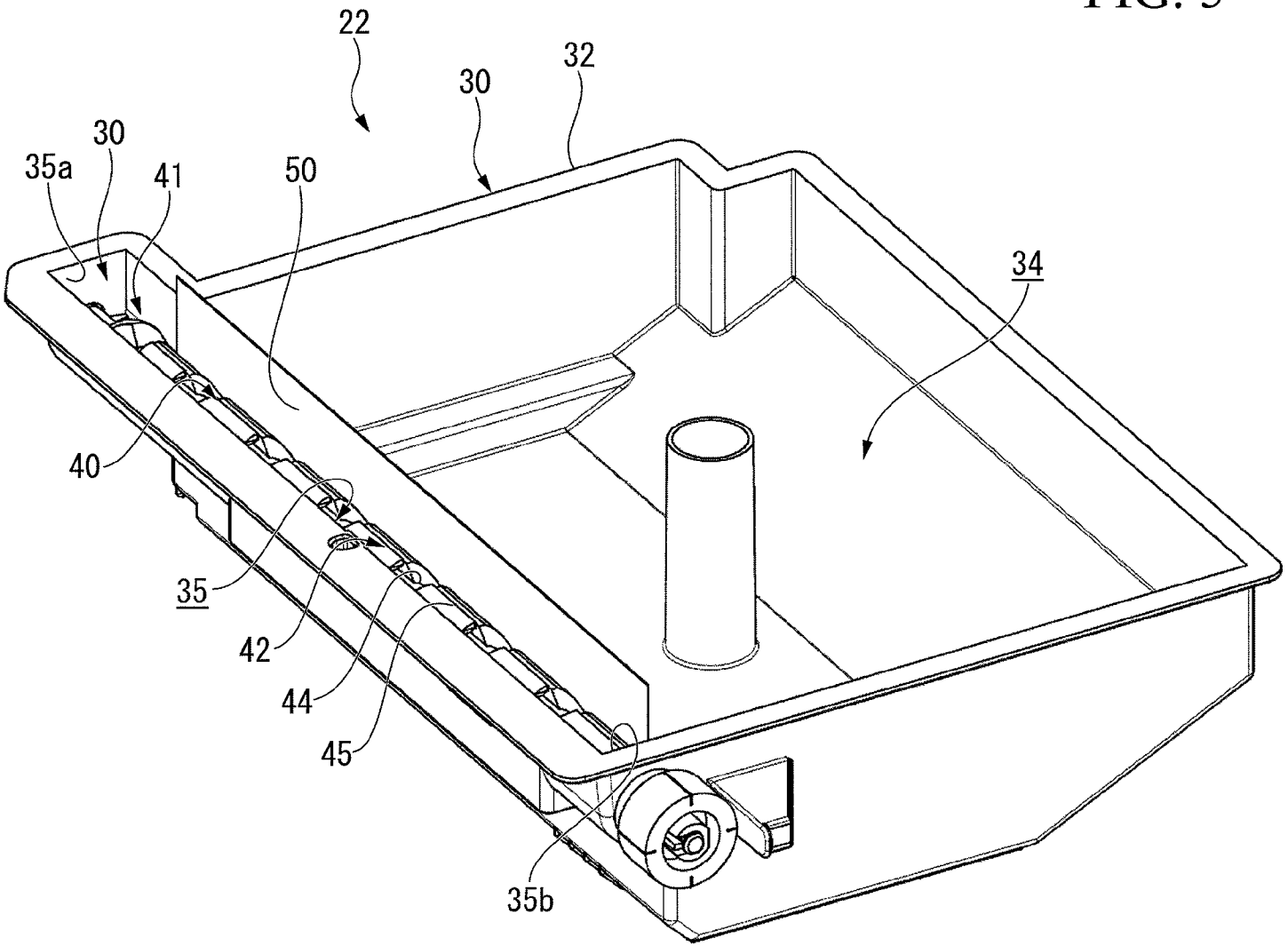
FIG. 5 is a perspective view of a toner recovery container in the embodiment of the present disclosure.

FIG. 5 is a perspective view of a toner recovery container 30 in the embodiment of the present disclosure.

Figure 6:
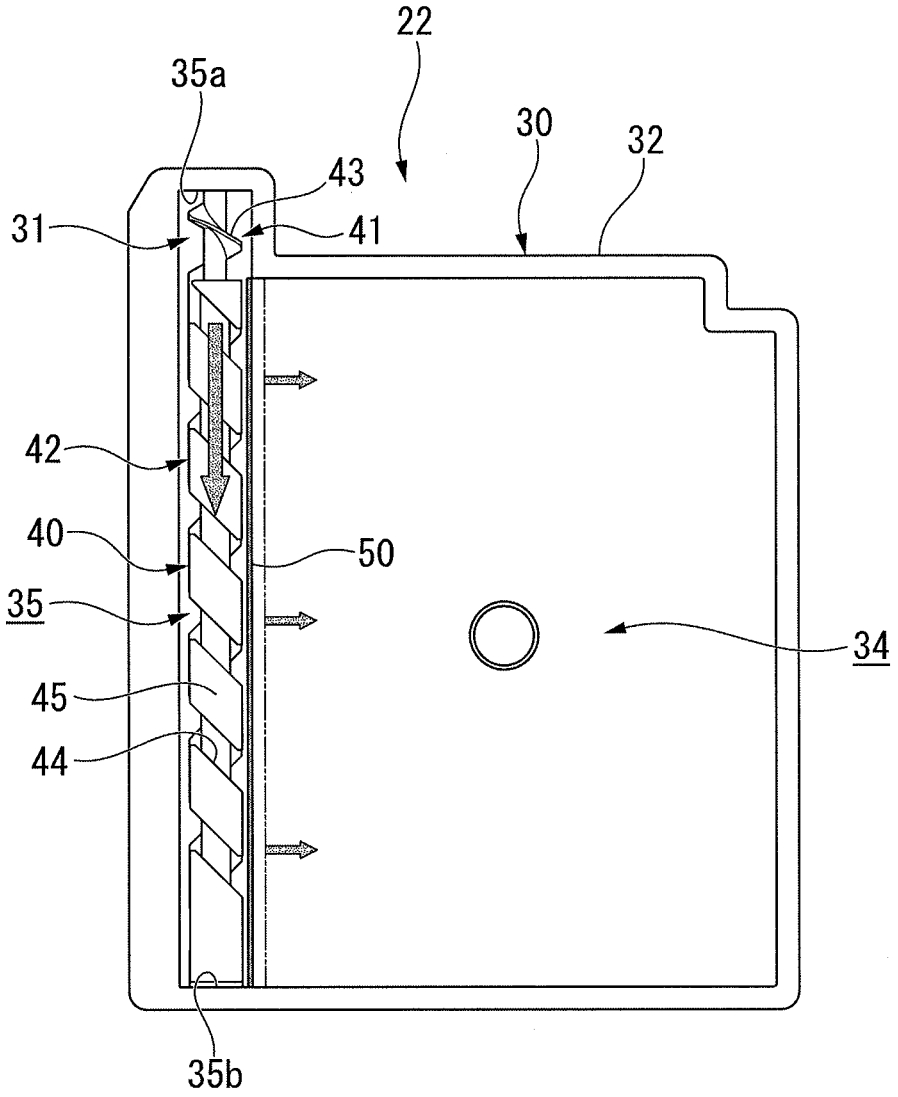
FIG. 6 is a plan view of the toner recovery container in the embodiment of the present disclosure.

FIG. 6 is a plan view of the toner recovery container 30 in the embodiment of the present disclosure.

As shown in FIG. 2, the toner recovery device 22 is connected with the photoreceptor unit 21.

The toner recovery device 22 has a toner recovery container 30 that recovers toner.

The toner recovery container 30 has a toner introduction part 31 connected with the terminal end of the second conveying pipe 219.

The toner removed by the cleaning device 215 is conveyed from the first conveying pipe 216*b* to the second conveying pipe 219, and is introduced from the terminal end of the second conveying pipe 219 via the toner introduction part 31 into the inside of the toner recovery container 30.

As shown in FIG. 3, the toner recovery container 30 has a container body 32 and a lid member 33 combined.

The toner recovery container 30 has a toner storage space 34 and a toner conveying path 35.

The toner storage space 34 is a space that finally stores the toner introduced into the inside of the container and has predetermined capacity.

The toner conveying path 35 is a space adjacent to the toner storage space 34, and is provided at a position higher than the bottom of the toner storage space 34.

The toner recovery device 22 has a toner conveying shaft member 40.

The toner conveying shaft member 40 is provided inside the toner conveying path 35.

As shown in FIGS. 5 and 6, the toner conveying shaft member 40 of the present embodiment is arranged along the toner conveying path 35, and is rotatably supported at a start end 35*a* and terminal end 35*b* of the toner conveying path 35.

The toner conveying shaft member 40 is given the rotational driving force of a motor (not shown) via a belt or a gear. As a result, the toner conveying shaft member 40 is rotated around the axis of the toner conveying shaft member 40.

The toner conveying path 35 extends the toner conveying shaft member 40.

Additionally, the toner conveying path 35 extends in the horizontal direction adjacent to a side portion of the toner storage space 34.

The toner conveying path 35 is connected with the toner introduction part 31.

The toner introduced from the toner introduction part 31 is first introduced into the toner conveying path 35, and is then introduced into the toner storage space 34 adjacent the toner conveying path 35.

The toner conveying shaft member 40 has a screw portion 41 and a shaft portion 42, as shown in FIG. 4A.

The screw portion 41 constitutes the portion of the toner conveying shaft member 40 corresponding to directly below the toner introduction part 31 (refer to FIG. 6).

In the screw portion 41, a thin screw blade 43 is provided and a sufficient space is provided in to receive and convey the toner introduced from the toner introduction part 31.

The screw portion 41 prevents clogging of toner within the toner introduction part 31 due to the space, and quickly feeds toner by the screw blade 43 from directly below the toner introduction part 31.

The shaft portion 42 constitutes the region of the toner conveying shaft member 40 corresponding to the toner conveying path 35 other than directly below the toner introduction part 31.

As shown in FIG. 4A, the shaft portion 42 is formed with a spiral groove 44 that conveys toner in the axial direction by the rotation around a rotational axis C.

The spiral groove 44 is formed at a predetermined depth with respect to an outer peripheral surface 45 of the shaft portion 42.

Grooves are formed in the spiral groove 44 of the present embodiment so that the intervals between grooves adjacent to each other in the axial direction become an equal pitch.

As shown in FIG. 4B, the shaft portion 42 has an outer peripheral surface 45 whose distance from the rotational axis C is variable.

The outer profile of the outer peripheral surface 45 of the present embodiment in a plane orthogonal to the rotational axis C is formed of an elliptical shape.

For this reason, if the toner conveying shaft member 40 rotates around the rotational axis C, toner is pushed out twice by one rotation in the direction that intersects the axial direction by a region corresponding to the ellipse major axis of the outer peripheral surface 45.

In addition, the shape of the outer profile of the outer peripheral surface 45 may not be limited to the ellipse, and may be, for example, a polygonal shape such as a triangle or a square, or a cam shape such as a star type or a deformed circle type.

As shown in FIG. 3, the toner recovery device 22 of the present embodiment has a sheet member 50.

The sheet member 50 is formed from a member that has flexibility, and is formed from a PET (polyethylene terephthalate) film in the present embodiment.

The sheet member 50 is hung from the inner surface side of the lid member 33, and the tip thereof extends to below the rotational axis C of the toner conveying shaft member 40.

In addition, the tip of the sheet member 50 is spaced apart from the bottom of the toner conveying path 35.

The sheet member 50 is arranged at a position where the sheet member comes into contact with the outer peripheral surface 45 of the toner conveying shaft member 40.

The sheet member 50 of the present embodiment is arranged at a position where the sheet member can come into contact with the region corresponding to the ellipse minor axis of the outer peripheral surface 45 in a state where there is no deflection.

Additionally, the sheet member 50 is provided along the boundary between the toner storage space 34 and the toner conveying path 35 (refer to FIGS. 5 and 6).

The sheet member 50 comes into contact with the whole shaft portion 42 of the toner conveying shaft member 40 over the whole axial direction, and the overall sheet swings.

Subsequently, the operation of the toner recovery device 22 of the above configuration will be described.

As shown in FIG. 3, non-transferred toner of the photoreceptor drum 211 is removed by the cleaning device 215.

The removed toner is conveyed to the toner recovery device 22 through the first conveying pipe 216*b* and the second conveying pipe 219 by the screw 216*a* or the like of the toner conveying device 216.

The conveyed toner is introduced into the inside of the toner recovery container 30 via the toner introduction part 31 of the toner conveying path 35 from the terminal end of the second conveying pipe 219.

As shown in FIG. 6, the toner introduced into the inside of the toner recovery container 30 is first supplied to the toner conveying path 35.

The toner conveying path 35 is provided with the toner conveying shaft member 40.

The toner conveying shaft member 40 conveys toner in the axial direction by the rotation around the rotational axis C.

The screw portion 41 quickly feeds toner in the axial direction from directly below the toner introduction part 31 by the screw blade 43.

Additionally, the shaft portion 42 further feeds toner toward the back side (terminal end 35*b* side) of the toner conveying path 35 in the axial direction by the spiral groove 44.

The spiral groove 44 on the present embodiment is formed in the elliptical outer peripheral surface 45.

Therefore, although the conveying force of the elliptical shape is somewhat inferior to that of a common true circle shape, since the elliptical shape resembles a true circle shape, the toner conveying force in the axial direction can be sufficiently secured.

As shown in FIG. 3, the toner conveying shaft member 40 has an outer peripheral surface 45 whose distance from the rotational axis C is variable.

For this reason, if the toner conveying shaft member 40 rotates around the rotational axis C, toner is pushed out in the direction that intersects the axial direction by the outer peripheral surface 45 whose distance from the rotational axis C is variable.

Additionally, the outer profile of the outer peripheral surface 45 in a plane orthogonal to the rotational axis C is formed of an elliptical shape.

For this reason, if the toner conveying shaft member 40 rotates once around the rotational axis C, conveying forces to push out toner twice in the direction that intersects the axial direction are generated by the outer peripheral surface 45.

According to the toner recovery device 22 of the present embodiment, if the toner conveying shaft member 40 rotates around the rotational axis C, as shown in FIG. 6, toner is conveyed to the spiral groove 44 in the axial direction.

Additionally, toner is pushed out in the direction that intersects the axial direction by the outer peripheral surface 45 whose distance from the rotational axis C is variable.

In this way, since the toner conveying shaft member 40 has toner conveying forces in two directions of the axial direction and the direction that intersects the axial direction, toner can be prevented from placing a disproportionate emphasis on only in one direction inside the container.

Accordingly, as in the toner recovery container 30 of the present embodiment, even in a case where the container shape in the axial direction of the toner conveying shaft member 40 and in the direction orthogonal to the axial direction is elongated, toner can be stored until the toner storage space 34 becomes full.

For this reason, the storage space can be widely utilized regardless of the shape of the toner recovery container 30, and the degree of freedom in selection of the container shape of the toner recovery container 30 also increases.

Additionally, the toner recovery device 22 of the present embodiment has the flexible sheet member 50 provided at the position where the sheet member comes into contact with the outer peripheral surface 45.

The force of conveying toner in the direction that intersects an axial direction can be increased by bringing the outer peripheral surface 45 of the toner conveying shaft member 40 into contact with the sheet member 50.

That is, if the toner conveying shaft member 40 rotates around the rotational axis C, since the sheet member 50 is pushed by the outer peripheral surface 45 whose distance from the rotational axis C is variable and the free end side of the sheet repeats reciprocal operation, the force conveying toner in the direction that intersects the axial direction increases.

Additionally, as shown in FIGS. 3 and 5, the sheet member 50 of the present embodiment is provided along the boundary between the toner storage space 34 and the toner conveying path 35.

For this reason, even in a state where the toner storage space 34 becomes full to some extent, the sheet member 50 can pack and push away the toner in the toner storage space 34 by the reciprocal movement and can positively form a space for introducing toner from the toner conveying path 35.

Accordingly, a larger amount of toner can be recovered inside the toner recovery container 30.

Additionally, the sheet member 50 can prevent backflow of the toner to return from the toner storage space 34 to the toner conveying path 35, and can also prevent the toner that has soared in the toner storage space 34 from being scattered to the outside of the toner recovery container 30.

For this reason, the apparatus inside of the copying machine A is not contaminated with toner even if the toner is recovered until the toner recovery container 30 becomes full.

In this way, according to the above-described present embodiment, a configuration is adopted in which the toner recovery device 22 of the present disclosure has the toner recovery container 30 that recovers toner, the toner conveying shaft member 40 that is provided inside the toner recovery container 30 and conveys toner in the axial direction by the rotation around the axis, and the toner conveying shaft member 40 has the spiral groove 44 formed around the rotational axis C and the outer peripheral surface 45 whose distance from the rotational axis C is variable.

By adopting the configuration of the present disclosure, the degree of freedom in the shape of the toner recovery container 30 is high, and the toner recovery device 22 that can store waste toner efficiently is obtained.

Additionally, according to the present embodiment, the copying machine A that can recover a larger amount of toner is obtained without occupying useless space inside the apparatus.

Although the preferred embodiment of the present disclosure has been described with reference to the accompanying drawings, the present disclosure is not limited to the above embodiment.

Various shapes or combinations of respective constituent members illustrated in the above-described embodiment are merely examples, and various changes may be made depending on design requirements or the like without departing from the scope of the present disclosure.

For example, a case where the spiral groove 44 is such that the intervals between grooves adjacent to each other in the axial direction become equal pitches has been described in the above embodiment. However, the present disclosure is not limited to this configuration, and may have configuration shown in the FIG. 7.

Figure 7:
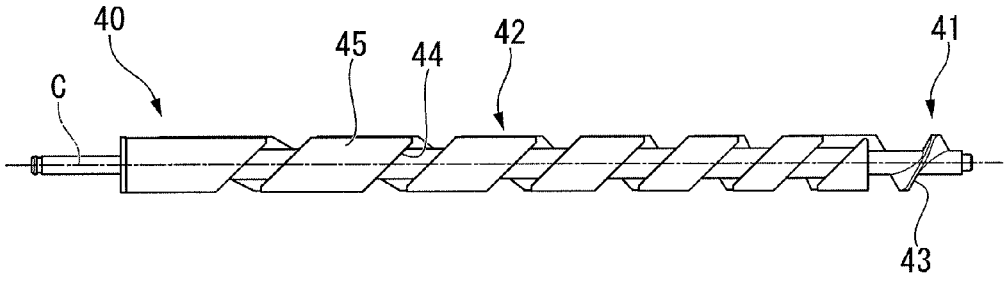
FIG. 7 is a configuration view of the toner conveying shaft member in a separate embodiment of the present disclosure.

FIG. 7 is a configuration view of a toner conveying shaft member 40 in a separate embodiment.

The spiral groove 44 in the separate embodiment is formed of a shape such that the interval between grooves adjacent to each other in the axial direction increases gradually as it goes from the start end 35*a* (corresponds to the right of the paper plane of FIG. 7) of the toner conveying path 35 to the terminal end 35*b* (corresponds to the left of the paper plane of FIG. 7).

That is, the spiral pitches of the spiral groove 44 increase toward the downstream side in the axial direction.

According to this configuration, toner cannot be excessively fed toward the downstream side in the axial direction by the spiral groove 44.

Accordingly, according to this separate embodiment, a larger amount toner can be recovered in high density in the overall container.

Additionally, although a case where the sheet member 50 is arranged so that the sheet member 50 can come into contact with the region corresponding to the ellipse minor axis of the outer peripheral surface 45 in a state where there is no deflection has been described in the above embodiment, the present disclosure is not limited to this configuration.

For example, the sheet member 50 may be arranged so that the sheet member 50 can come into contact with the region corresponding to the ellipse major axis of the outer peripheral surface 45 in a state where there is no deflection.

However, it is more preferable to arrange the sheet member so that the sheet member 50 can come into contact with the region (region where the distance from the rotational axis C to the outer peripheral surface 45 becomes minimum) corresponding to the ellipse minor axis of the outer peripheral surface 45 because the stroke of the reciprocal operation becomes large and therefore the toner conveying force becomes high.

Additionally, although a case where the sheet member 50 is constituted by one sheet of film, for example, has been described in the above embodiment, the present disclosure is not limited to this configuration.

For example, the sheet member 50 may be constituted by two or more sheets of film.

However, there is also a case where the reciprocal operation may not be synchronously performed due to the relationship, such as being caught by the spiral groove 44 formed in the outer peripheral surface 45, distribution may occur in the toner conveying force.

For this reason, a configuration in which the sheet member is integrally swung by a single sheet of film is more preferable.

Additionally, although a copying machine, for example, has been illustrated as the image forming apparatus in the above embodiment, the present disclosure can also be applied to image forming apparatuses, such as a printer and a facsimile machine.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A toner recovery device comprising:

a toner recovery container that recovers toner, toner recovery comprising a toner storage space that stores toner; and a toner conveying path that is adjacent to the toner storage space and extends along the toner conveying shaft member; and a toner conveying shaft member that is provided inside the toner recovery container and conveys toner in a axial direction of the toner conveying shaft member by the rotation around a rotational axis of the toner conveying shaft member and that has a spiral groove formed around the rotational axis and an outer peripheral surface whose distance from the rotational axis is variable, the groove having a constant width wherein the spiral groove is formed of a shape such that the intervals between groove turns adjacent to each other in the axial direction increase gradually in a direction from a start end of the toner conveying path to a terminal end thereof.

2. The toner recovery device according to claim 1, wherein an outer profile of the outer peripheral surface in a plane orthogonal to the rotational axis is formed of an elliptical shape.

3. The toner recovery device according to claim 1, further comprising:

a sheet member that has flexibility and is provided at a position where the sheet member comes into contact with the outer peripheral surface.

4. The toner recovery device according to claim 3, wherein the sheet member is provided along a boundary between the toner storage space and the toner conveying path.

5. An image forming apparatus comprising:

an image carrier that carries a transfer image formed with toner;

a cleaning device that removes toner remaining on the image carrier; and a toner recovery device that recovers the toner removed by the cleaning device, wherein the toner recovery device is the toner recovery device according to claim 1.

6. The toner recovery device according to claim 1, wherein the toner recovery container further comprises a toner introduction part through which the toner is introduced into an inside of the toner recovery container, and the toner conveying shaft member comprises a screw portion that feeds the toner in the axial direction from directly below the toner introduction part.

7. The toner recovery device according to claim 6, wherein an outer profile of the screw portion in a plane orthogonal to the axis direction is circular.

* * * * *